United States Patent [19]

Nakaho et al.

[11] 4,316,168

[45] Feb. 16, 1982

[54] ELECTRICAL CIRCUIT BREAKER HAVING A BIMETAL PLATE MEMBER OF RECTANGULAR CONFIGURATION

[75] Inventors: Junichi Nakaho, Ichinomiya; Takao Ougimoto, Gifu, both of Japan

[73] Assignee: Kabushiki Kaisha Tokai Rika Denki Seisakusho, Nishi, Japan

[21] Appl. No.: 194,276

[22] Filed: Oct. 6, 1980

[30] Foreign Application Priority Data

Oct. 12, 1979 [JP] Japan ..... 54-141921[U]

[51] Int. Cl.[3] ..... H01H 37/52; H01H 37/74

[52] U.S. Cl. ..... 337/359; 337/358; 337/67; 337/70

[58] Field of Search ..... 337/359, 358, 357, 356, 337/67, 70, 72, 75, 76

[56] References Cited

U.S. PATENT DOCUMENTS 3,416,117 12/1968 Brauckmann ..... 337/358

4,092,623 5/1978 Kirkup ..... 337/70

*Primary Examiner*—Harold Broome

*Attorney, Agent, or Firm*—Wenderoth, Lind & Ponack

[57] ABSTRACT

An improved electrical circuit breaker which is so arranged that, by the deflection of a bimetal plate of approximately rectangular configuration having, at its opposite ends, electrical contacts contacting corresponding portions of terminal plates under a predetermined contact pressure, the engagement of the central portion of the bimetal plate and an engaging member is released so as to cause the bimetal plate to move in the direction normal to the direction of application of the contact pressure by spring force of a spring member through a holder member for cutting off electrical connection between the terminal plates.

11 Claims, 11 Drawing Figures

ELECTRICAL CIRCUIT BREAKER HAVING A BIMETAL PLATE MEMBER OF RECTANGULAR CONFIGURATION

BACKGROUND OF THE INVENTION

The present invention generally relates to an electrical circuit breaker and more particularly, to an electrical circuit breaker employing a bimetal.

Conventionally, in the circuit breaker employing a bimetal, the so-called contact plate or resilient plate type circuit breaker has been well known.

The known circuit breaker of the above described type includes, for example, as shown in FIG. 1, a housing 1, and a disc-like bimetal plate 3 having an arculate curved cross section and fixed at its central portion, to an end of an adjusting screw 2 threaded into a base portion of the housing 1 to extend into said housing. When a rated current is flowing, contacts 4a and 4b provided at opposite ends on one surface of the bimetal plate 3 are caused to contact, through deflection of the bimetal plate 3, corresponding contacts *7a* and *7b* provided at the base portions of a pair of terminal plates 5 and 6 extending outwardly from the housing 1 and connected to the power source through a load or resistance R and a switch SW, while on the other hand, if an overcurrent flows through the circuit breaker, the disc-like bimetal is caused to deflect in the opposite direction as shown in dotted lines in FIG. 1 so that the contacts 4*a* and 4*b* thereof are spaced from the corresponding contacts *7a* and *7b* of the terminal plates 5 and 6 for cutting off the electrical connections therebetween.

The conventional contact plate type circuit breaker as described above, however, has such disadvantages that, since the disc-like bimetal plate 3 is formed by press work, it is difficult to achieve high dimensional accuracy of said bimetal plate and therefore, adjusting mechanisms such as the adjusting screw 2 and the like are required to provide correct temperature range for the deflection of the bimetal plate 3 in the opposite direction, i.e. to provide an accurate set value against the overcurrent, thus resulting in complication of construction and consequent large size of the circuit breaker itself.

Moreover, in the known circuit breaker of the above described type, since the contact pressure is obtained by deflecting the bimetal plate 3, said contact pressure tends to deviate from product to product, and moreover, due to the fact that the contact pressure affects the deformation of the bimetal plate 3, it is extremely difficult to achieve accurate set value for the bimetal plate 3 against overcurrent.

SUMMARY OF THE INVENTION

Accordingly, an essential object of the present invention is to provide an improved electrical circuit breaker which is simple in construction, compact in size and free from manufacturing errors in the bimetal plate, by arranging in such a manner that the bimetal is formed into generally a rectangular shape capable of being accurately and readily manufactured, and respective contacts provided at opposite ends at one surface of said bimetal plate are caused to contact corresponding terminal plates under a predetermined contact pressure so that, by the deflection of the bimetal plate during overcurrent period, engagement between approximately central portion of the bimetal plate and engaging means is released so as to move holding means of the bimetal plate in a direction at right angles with respect to the direction of application of said contact pressure together with said bimetal plate by spring force of spring means for cutting off electrical connections between the contacts and terminals.

Another important object of the present invention is to provide an improved electrical circuit breaker of the above described type in which the bimetal plate is free from undesirable deformation by the contact pressure, without deviation of the contact pressure from product to product so as to present a circuit breaker easy to manufacture and having the bimetal plate correct in the amount of deformation with respect to overcurrent by arranging to apply pressure through the holding means, to the portions on the other surface of the bimetal plate corresponding to said contacts for the application of the contact pressure thereat.

In accomplishing these and other objects, according to one preferred embodiment of the present invention, there is provided an electrical circuit breaker which includes a housing having a pair of terminal plates fixed therein, a bimetal plate member of approximately rectangular configuration having, at opposite ends on one surface thereof, a corresponding pair of contacts respectively contacting the terminal plates, a holder member holding the bimetal plate member so as to apply contact pressure to portions on the other surface of the bimetal plate member corresponding to the contacts and reciprocatingly movable in a direction normal to the direction of application of the contact pressure, engaging means which is arranged to be engaged with the bimetal plate member during flowing of rated current for retaining the bimetal plate member in position to electrically connect the terminal plates and to be disengaged from the bimetal plate member through deflection of the bimetal plate member upon flowing of overcurrent, and spring means which normally urges the holder member in one direction and which, upon disengagement between the engaging means and bimetal plate member, causes the bimetal plate member to move in the one direction together with the holder member for cutting off electrical connection between the terminal plates, with the bimetal plate member, holder member, engaging means and spring means being operably accommodated in the housing.

By the arrangement according to the present invention as described above, the improved circuit breaker simple in structure and compact in size, without deviations in the functioning characteristics thereof has been advantageously presented, with substantial elimination of disadvantages inherent in the conventional circuit breakers of the kind.

BRIEF DESCRIPTION OF THE DRAWINGS

These and other objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 2:
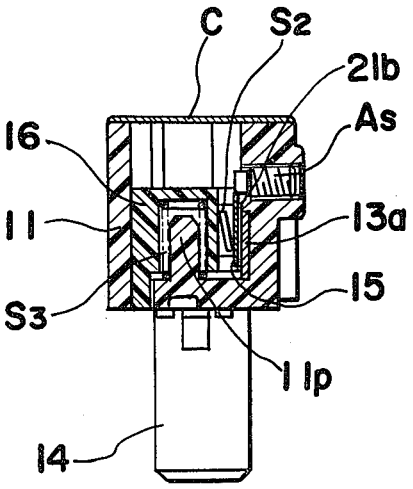
Figure 2:
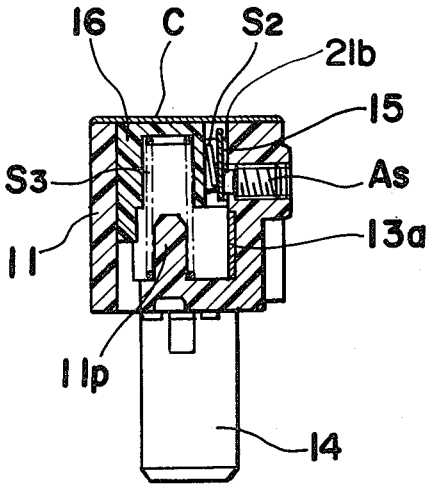

Referring now to the drawings, there is shown in FIGS. 2(*a*) to 3, an improved circuit breaker according to one preferred embodiment of the present invention which generally includes a housing or casing 11 of electrically insulative material having terminal plates 13 and 14 suitably secured to a bottom wall of said housing 11 so as to extend downwardly therefrom for external connection, an upright post 11p extending upwardly within the housing 11 in a position at approximately the central portion of said bottom wall, an adjusting screw As threaded into one side wall of the housing 11 in a position corresponding to the upright post 11*p*, and a vertical groove 11*g* formed in the other side wall of said housing in a position also corresponding to said upright post 11*p*, a coil spring S3 to be fitted over the upright post 11*p*, a bimetal plate 15 of generally U-shaped cross section having contacts 21*a* and 21*b* at its opposite sides, a holder member 16 of generally rectangular box-like shape which has one side face 16*f* formed with two holes $16_0$ to receive corresponding spring members S1 and S2 and receiving the bimetal plate 15 so as to be urged outwardly through the spring members S1 and S2, with the opposite ends 15*e* of the bimetal plate 15 being fitted over stepped portions 16s provided at opposite sides of the holder member 16 to be retained thereat, a vertical projection 16*p* provided on the other side face of the holder member 16 so as to be fitted into the groove 11*g* when the holder member 16 is accommodated in the housing 11 through another spring member S3 fitted over the upright post 11*p* and received at its one end in a bore 16*h* formed in the under face of the holder member 16, and a cover plate C which is fitted over the upper opening of the housing 11 and retained on said housing 11 through engagement of bent portions Cl thereof with corresponding recesses or notches 11*r* formed around peripheral edge of the housing 11.

For assembly, the holder member 16 on which the bimetal plate 16 is fitted over in the above described manner is slidably housed into the housing 11 through the spring member S3 and, while the rated current is flowing, held in position against the urging force of the spring member S3 by the engagement of the tip of the adjusting screw As with a protruding edge 15*p* provided on an upper edge at the central portion 15*a* of the bimetal plate 15, with the contacts 21*a* and 21*b* of the bimetal plate 15 contacting base portions 13*a* and 14*a* of the terminal plates 13 and 14 within the houding 11, while the cover plate C is applied onto the housing 11.

Figure 1:
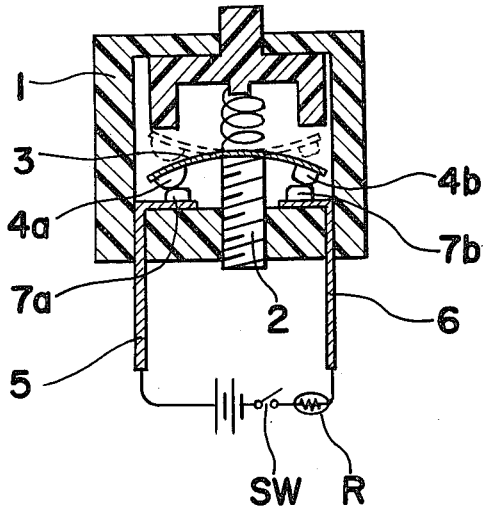
Fig. 1 PRIOR ART
FIG. 1 is a side sectional view showing the construction of a conventional contact plate type circuit breaker (already referred to), FIGS. 2(*a*) and 2(*b*) are side sectional views showing an improved circuit breaker according to one preferred embodiment of the present invention in ON and OFF positions respectively.
Figure 3:
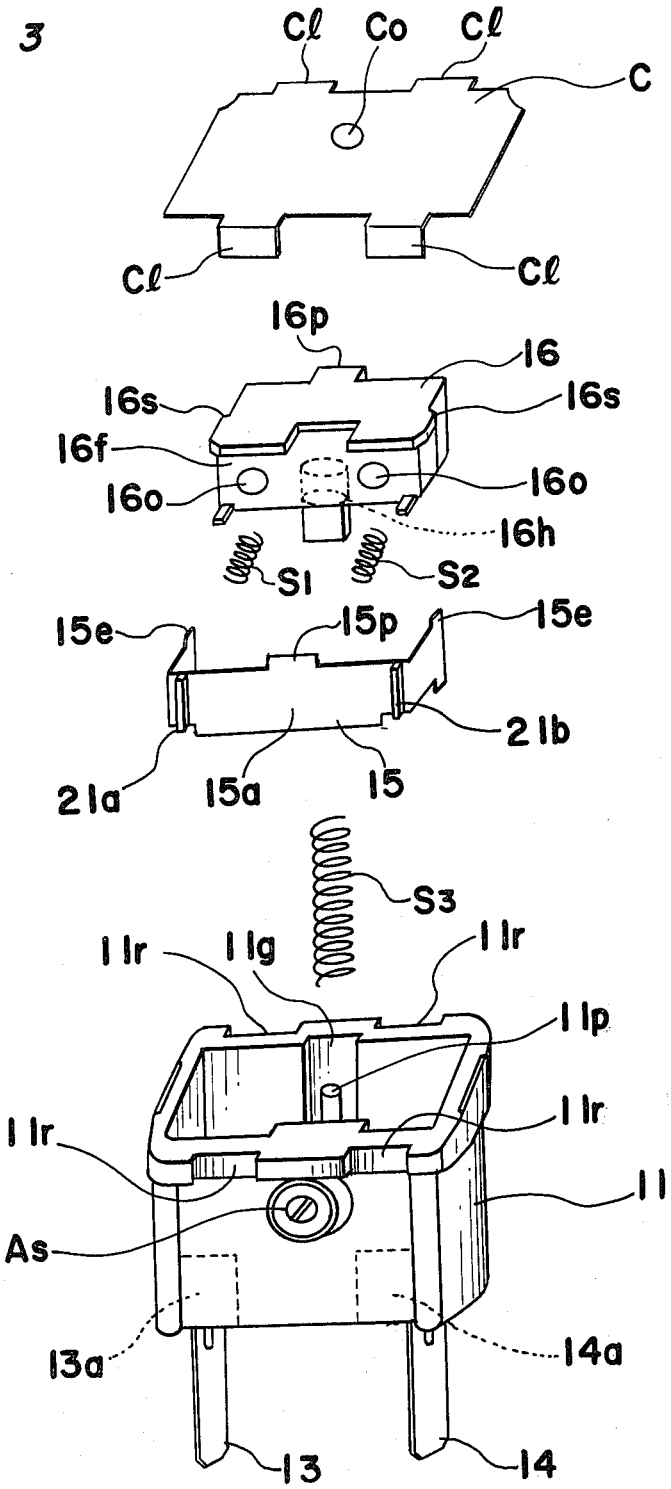
FIG. 3 is an exploded view of the circuit breaker of FIG. 2.

By the above arrangement, as far as the rated current is flowing through the circuit breaker, the bimetal palte 15 is hardly curved or deflected, and the engagement between the adjusting screw As and the bimetal plate 15 is maintained, with the contacts 21*a* and 21*b* of the bimetal plate 15 kept in contact with the corresponding base portions 13*a* and 14*a* of the terminal plates 13 and 14 to establish electrical conduction therebetween (FIG. 2(*a*)). It is to be noted that the adjusting screw As in the above arrangement of the present invention merely functions as an engaging means with respect to the bimetal plate 15 and is not directly fixed to the bimetal as in the conventional circuit breaker of FIG. 1. In the above case, since the contacts 21*a* and 21*b* of the bimetal plate 15 are pressed against the corresponding base portions 13*a* and 14*a* of the terminal plates 13 and 14 under a predetermined contact pressure by the spring force of the spring members S1 and S2, the bimetal plate 15 is free from undue deformation. On the contrary, when overcurrent flows, the bimetal plate 15 is curved or deflected with its central portion 15*a* being spaced from the distal end of the adjusting screw As, and therefore, the bimetal plate 15 urged in a direction at right angles with respect to the direction of application of the contact pressure through the holder member 16 by the spring member S3 is rapidly moved upwardly in FIG. 3, and thus, the contacts 21*a* and 21*b* of the bimetal plate 15 slide from the surfaces of the base portions 13*a* and 14*a* of the terminal plates 13 and 14 over to the inner surface of the housing 11 of electrically insulative material for cutting off the electrical connection therebetween (FIG. 2(*b*)). Even during the sliding movement as described above, approximately constant pressure is applied to the contacts 21*a* and 21*b* of the bimetal plate 16 by the spring members S1 and S2.

For resetting the circuit breaker actuated in the above described manner to the original state where the contacts 21*a* and 21*b* of the bimetal plate 15 contact the base portions 13*a* and 14*a* of the terminal plates 13 and 14 for electrical connection therebetween, a rod member or the like (not shown) is inserted into the housing 11 through an opening Co formed in the cover plate C for depressing the holding member 16 downward so as to engage the distal end of the adjusting screw As with the protruding edge 15*p* of the bimetal plate 15.

It is needless to say that the rod member or the like as described above may be incorporated in the housing 11 or integrally formed with the upper surface of the holder member 16 so as to extend partially outwardly from the opening Co for convenience in the resetting.

Figure 4:
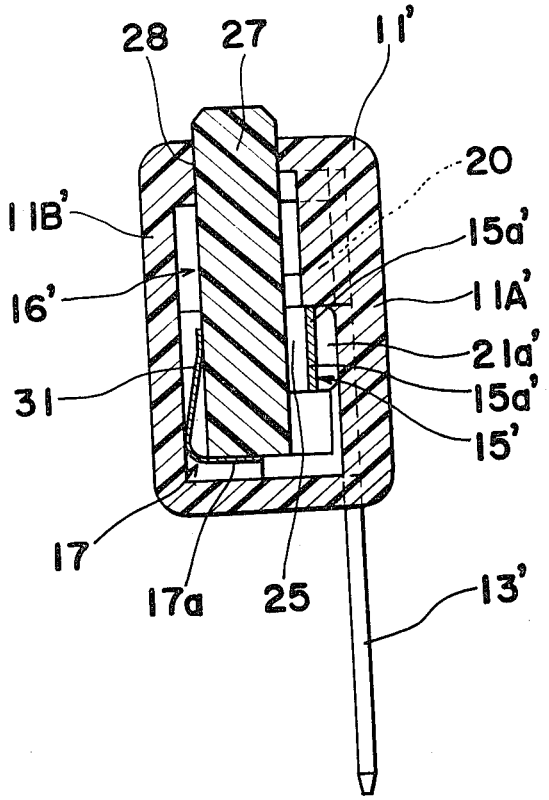
FIG. 4 is a view similar to FIG. 2, which particularly shows a second embodiment thereof.
Figure 6:
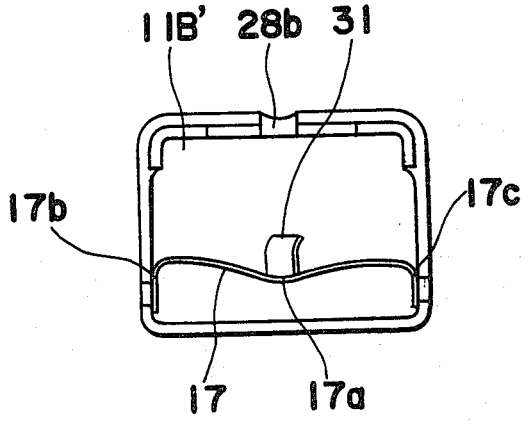
FIG. 6 is a side elevational view of one half of the housing of the circuit breaker of FIG. 4 explanatory of the positioning of a plate spring member, and FIGS. 7(*a*) to 7(*d*) are fragmentary sectional views explanatory of functionings of the circuit breaker of FIG. 4.
Figure 5:
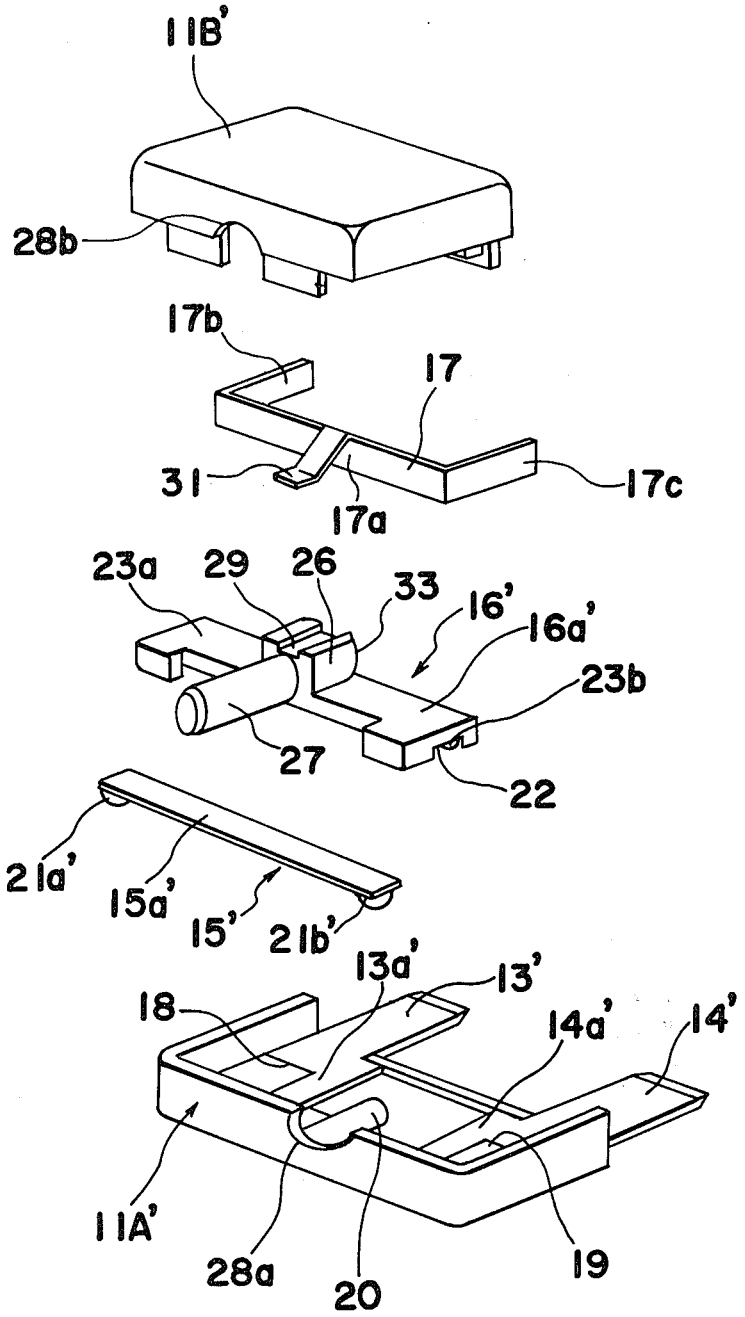
FIG. 5 is an exploded view of the circuit breaker of FIG. 4.
Figure 7A:
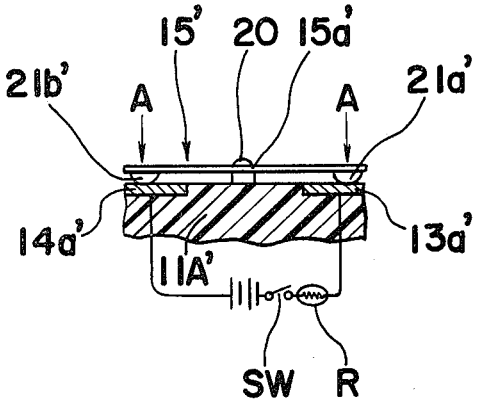
Figure 7B:
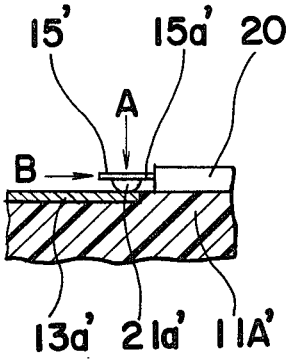
Figure 7C:
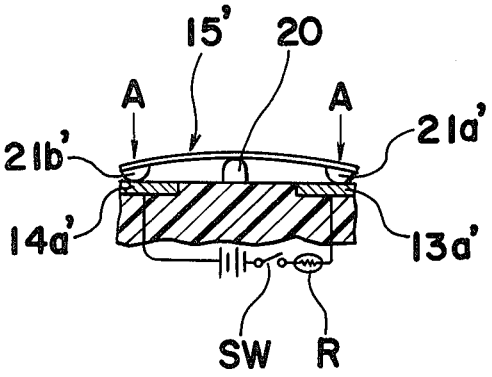
Figure 7D:
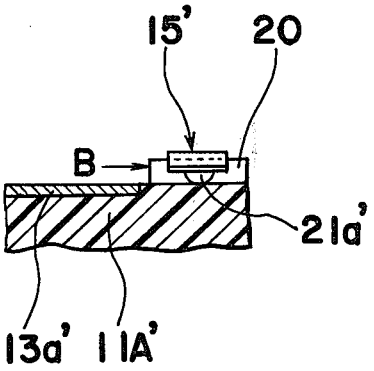

Referring particularly to FIGS. 4 to 6, there is shown a circuit breaker according to a second embodiment of the present invention which generally includes a housing 11' of electrically insulative material which may be divided into two portions, i.e. into counterparts 11A' and 11B', a pair of terminal plates 13' and 14' extending outwardly from the housing counterpart 11A' in parallel relation to each other, a bimetal plate 15' accommodated in the housing 11' for selectively establishing or cutting off electrical connection between the terminal plates 13' and 14', a holder member 16' for holding the bimetal plate 15', and a plate spring member 17 for urging said holder member 16' in one direction.

The terminal plates 13' and 14' each made of flat plates of electrically conductive material have notched base portions 13*a'* and 14*a'* which are closely fitted into corresponding recesses or grooves 18 and 19 formed in the counterpart 11A' (FIG. 5) and secured thereat to be flush with part of the inner surface of said counterpart 11A'. In a position between the base portions 13a' and 14a' of the terminal plates 13' and 14', engaging means or a projection 20 for engagement with the bimetal plate 15' is integrally formed with the inner surface of the counterpart 11A' so as to extend in the direction of the terminal plates 13' and 14'. Meanwhile, the bimetal plate 15' is formed into a rectangular shape for deflection by a predetermined amount during overcurrent period, and provided with contacts 21a' and 21b' at opposite ends of its one surface. The holder member 16' has a rectangular base portion 16a' which is formed with a groove or recess 22 in its one side face for receiving therein the other surface without the contacts 21a' and 21b' of the bimetal plate 15'. The groove 22 is provided, at its opposite ends, with pressure applying projections 23a and 23b in positions corresponding to the contacts 21a' and 21b' of the bimetal plate 15' for applying the contact pressure to said contacts through the projections 23a and 23b, while a gap or clearance 25 is provided between the central portion 15a' of the bimetal plate 15' and the holder member 16' as shown in FIG. 4 for permitting the central portion 15a to deflect toward the left in FIG. 4. At the central portion on the other side of the base portion 16a' of the holder member 16', there is provided a protrusion 26, on the upper surface of which a groove 29 is formed to extend in a direction normal to the groove 22 (FIG. 5). Furthermore, from the side face of the protrusion 26, a knob 27 of circular cross section extends laterally in a direction parallel to the groove 29.

The holder member 16 having the bimetal plate 15 fitted into the groove 22 thereof as described above is to be slidably accommodated in the housing 11' for sliding movement in the direction parallel to the inner surface of the counterpart 11A' and terminal plates 13' and 14', with the contacts 21a' and 21b' of the bimetal plate 15' contacting the base portions 13a' and 14a' of the terminal plates 13' and 14', and with the knob 27 extending outwardly from the housing 11' through semicircular notches 28a and 28b formed in the corresponding portions of the counterparts 11A' and 11B' to form an opening 28 when combined. In the above case, the sliding movement of the holder member 16' is normally restricted during the rated current period by the engagement of the projection or engaging means 20 formed in the counterpart 11A' with the central portion 15a' of the bimetal plate 15'.

On the other hand, the plate spring member 17 formed by folding a rectangular plate into a C-shape is provided with a resilient tongue 31 formed by folding back a projected portion thereof at the central portion as is seen from FIG. 5. As shown in FIG. 6, the plate spring member 17 is incorporated into the interior of the counterpart 11B' of the housing 11', with the tongue 31 thereof directed toward the semi-circular notch 28b of the counterpart 11B', and with opposite ends 17b and 17c thereof contacting under pressure the inner surface of said counterpart 11B'. The counterpart 11B' in which the plate spring member 17 has been incorporated in the above described manner is rigidly combined with the counterpart 11A', by fitting the tongue 31 into the groove 29 of the holder member 16', with the central portion 17a of the plate spring member 17 being pressed against the side or bottom face 33 of the protrusion 26 of the holder member 16'.

In the above state, the contact pressure for the contacts 21a' and 21b' of the bimetal plate 15' with respect to the base portions 13a' and 14a' of the terminal plate 13' and 14' is applied by the spring force of the tongue 31 of the plate spring member 17 through the pressure applying projections 23a and 23b of the holder member 16' without imparting any deformation to the bimetal plate 15', while the spring force due to the deflection at the central portion 17a of the plate spring member 17 presses the edge of the central portion 15a' of the bimetal plate 15' against the projection 20 in the inner surface of the counterpart 11A' for engagement therebetween.

Referring particularly to FIGS. 7(*a*) to 7(*d*), the functionings of the circuit breaker of FIGS. 4 to 6 will be described hereinbelow.

As shown in FIGS. 7(*a*) and 7(*b*), the bimetal plate 15' hardly deflects or curves while the rated current is flowing through the circuit breaker. Therefore, the edge at the central portion 15a' of the bimetal plate 15' and the projection 20 are in engagement, and the bimetal plate 15' is prevented from movement, even if it is urged in one direction by the spring force of the plate spring member 17 through the holder member 16', and thus, the respective contacts 21a' and 21b' of the bimetal plate 15' are kept in contact with the corresponding base portions 13a' and 14a' of the terminal plates 13 and 14 which are connected to the power source through the switch SW and a load resistor R. Moreover, in the above case, since the contacts 21a' and 21b' of the bimetal plate 15' are respectively pressed against the base portions 13a' and 14a' through the pressure applying projections 23a and 23b corresponding thereto by the spring force of the tongue 31 of the plate spring member 17 under a predetermined contact pressure A, the bimetal 15' is not subjected to deformation by said contact pressure.

On the other hand, when an overcurrent flows through the circuit breaker, the bimetal plate 15' curves upward at its central portion to be spaced from the projection 20, and since the bimetal plate 15' is urged in a direction B normal to the direction of the contact pressure A by the spring force of the plate spring member 17, it rapidly moves toward the right in FIG. 7(*d*), with the central portion 15a' of the bimetal plate 15' passing over the projection 20 as shown in FIGS. 7(*c*) and (*d*). In the above case, the contacts 21a' and 21b' of the bimetal plate 15' respectively slide from the base portions 13a' and 14a' of the terminal plates 13' and 14' over to the inner surface of the counterpart 11A' for cutting off the electrical connection between the terminals 13' and 14'. Even during the functioning as described above, approximately constant contact force A is applied to the respective contacts 21a' and 21b' by the spring force of the tongue 31 through the pressure applying projections 23a and 23b (FIG. 5).

For resetting the above described circuit breaker back into the original state where the terminal plates 13' and 14' are electrically connected to each other, the knob 27 as described with reference to FIGS. 4 and 5 is manually pressed inward so as to return the bimetal plate 15' to the original position together with the holder member 16 for engagement of the upper edge at central portion 15a' of the bimetal plate 15' with the projection 20.

It should be noted here that the projection 20 described above as employed in the above embodiment of FIGS. 4 to 6 for the engaging means may be replaced by a concave portion or recess (not shown) formed in the counterpart 11A and a projection (not shown) formed at the central portion 15*a*′ of the bimetal plate 15′ for engagement therebetween.

It should also be noted that the projection 20 described as integrally formed with the counterpart 11A′ may be replaced by a screw member (not shown) threaded into the counterpart 11A for adjustments of the amount of engagement between the screw member and the central portion of the bimetal plate through turning of the screw member as in the first embodiment, by which arrangement, a circuit breaker having set values for various overcurrents can readily be produced.

It is further to be noted that the number of the terminal plates and that of the corresponding contacts are not limited to be two each as described in the foregoing embodiments, but may be further increased depending on necessity according to constructions of circuits to be dealt with.

As is clear from the foregoing description, in the improved circuit breaker according to the present invention, it is so arranged that, by the deflection of the bimetal plate of approximately rectangular configuration having at the opposite ends thereof, the contacts contacting the corresponding portions of the terminal plates under the predetermined contact pressure, the engagement of the central portion of the bimetal plate and the engaging means is released so as to cause the bimetal plate to move in the direction normal to the direction of application of the contact pressure by the spring force of the spring member through the holder member for cutting off electrical connnection between the terminal plates, and therefore, the characteristics of the circuit breaker with respect to the overcurrents may be determined by the configuration of the bimetal plate of rectangular shape whose required dimensions are correctly and readily obtained during manufacturing, and the amount of engagement between the bimetal plate and the engaging means or the projection. Accordingly, the circuit breaker of the present invention is not only stable in the functioning characteristics thereof, but can be made simple in construction and compact in size, since no particular adjusting mechanism is required.

Furthermore, in the circuit breaker according to the present invention, since the contact pressure is applied to the contacts by applying pressure to the points at the other surface of the bimetal plate corresponding to said contacts, the contact pressure is free from deviation from product to product, without any deformation imparted to the bimetal plate. Therefore, the amount of deflection of the bimetal plate with respect to the overcurrents can be accurately set, thus presenting the circuit breaker without deviation in the performance through simple manufacturing processing. Moreover, since the contacts are arranged to quickly slide over the base portions of the terminal plates by the spring force in a direction normal to the direction of application of the contact pressure for cutting off the electrical connection between the terminal plates, there is no possibility that the contacts are fused to the terminal plates by electric arc, etc.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as included therein.

What is claimed is:

1. An electrical circuit breaker which comprises a housing having a plurality of terminal plates fixed therein, a bimetal plate member of approximately rectangular configuration having, at opposite ends on one surface thereof, corresponding contacts respectively contacting said terminal plates, a holder member holding said bimetal plate member so as to apply contact pressure to portions on the other surface of the bimetal plate member corresponding to said contacts and reciprocatingly movable in a direction normal to the direction of application of said contact pressure, engaging means which is arranged to be engaged with said bimetal plate member during flowing of rated current for retaining said bimetal plate member in position to electrically connect said terminal plates and to be disengaged from said bimetal plate member through deflection of said bimetal plate member upon flowing of overcurrent, and spring means which normally urges the holder member in one direction and which, upon disengagement between the engaging means and bimetal plate member, causes the bimetal plate member to move in the one direction together with the holder member for cutting off electrical connection between said terminal plates, said bimetal plate member, holder member, engaging means and spring means being operably accommodated in said housing.

2. An electrical circuit breaker as claimed in claim 1, wherein said housing includes first and second housing counterparts for operably accommodating therein said bimetal plate member, holder member, engaging means and spring means, when combined with each other.

3. An electrical circuit breaker as claimed in claim 1, wherein said contact pressure is applied to the other surface of said bimetal plate member at position corresponding to said contacts by coil spring members provided between said holder member and said bimetal plate member.

4. An electrical circuit breaker as claimed in claim 1, wherein said contact pressure is applied to the other surface of said bimetal plate member at position corresponding to said contacts through pressure applying projections provided in said holder member which is urged toward said contacts by tongue spring member provided on said spring means.

5. An electrical circuit breaker as claimed in claim 1, wherein said engaging means is an adjusting screw threaded into said housing for engaging, at its distal end, said bimetal plate member during the flowing of the rated current through said circuit breaker.

6. An electrical circuit breaker as claimed in claim 1, wherein said engaging means is a projection integrally formed with said housing for engaging, at its one end, said bimetal plate member during flowing of the rated current through said circuit breaker.

7. An electrical circuit breaker as claimed in claim 1, wherein said engaging means is a recessed portion formed in said housing for engagement with a corresponding projection formed on said bimetal plate member during flowing of the rated current through said circuit breaker.

8. An electrical circuit breaker as claimed in claim 1, wherein said spring means is a coil spring member disposed between a bottom wall of said housing and said holder member for normally urging said holder member in said one direction which is at right angles with respect to the direction of application of said contact pressure.

9. An electrical circuit breaker as claimed in claim 1, wherein said spring means is a plate spring member disposed between the bottom wall of said housing and said holder member for normally urging said holder member in said one direction which is at right angles with respect to the direction of application of said contact pressure.

10. An electrical circuit breaker as claimed in claim 1, further including a cover plate having an opening therein for insertion of a rod member therethrough so as to depress said holder member downward for resetting of said circuit breaker upon disengagement of said engaging means from said bimetal plate member.

11. An electrical circuit breaker as claimed in claim 1, wherein said holder member has a knob portion extending outwardly from said housing so as to depress said holder member downward for resetting of said circuit breaker upon disengagement of said engaging means from said bimetal plate member.

* * * * *